United States Patent [19]

Farcasiu et al.

[11] 4,133,646

[45] Jan. 9, 1979

[54] PHENOLIC RECYCLE SOLVENT IN TWO-STAGE COAL LIQUEFACTION PROCESS

[75] Inventors: Malvina Farcasiu, Princeton; Thomas O. Mitchell, Trenton; Darrell Duayne Whitehurst, Titusville, all of N.J.

[73] Assignee: Electric Power Research Institute, Inc., Palo Alto, Calif.

[21] Appl. No.: 811,113

[22] Filed: Jun. 29, 1977

[51] Int. Cl.[2] ..... C10L 9/10; C10G 11/04; C10G 11/06; C10B 57/00

[52] U.S. Cl. ..... 44/1 R; 44/1 F; 208/8; 208/10; 208/263; 201/17

[58] Field of Search ..... 208/8, 10, 14, 15, 144, 208/145, 263; 44/1 R, 1 C, 1 B, 1 F; 201/17

[56] References Cited

U.S. PATENT DOCUMENTS

| | | | |
|---|---|---|---|
| 1,838,547 | 12/1931 | Haslam et al. | 208/58 |
| 1,838,548 | 12/1931 | Haslam et al. | 208/8 |
| 3,117,921 | 1/1964 | Gorim | 208/144 |
| 3,503,864 | 3/1970 | Nelson | 208/8 |
| 3,594,304 | 7/1971 | Seitzer et al. | 208/8 |
| 3,617,531 | 11/1971 | Schlicht | 208/263 |
| 3,997,425 | 12/1976 | Gatsis et al. | 208/8 |
| 4,056,460 | 11/1977 | Malek | 208/8 |

*Primary Examiner*—P. E. Konopka
*Attorney, Agent, or Firm*—Townsend and Townsend

[57] ABSTRACT

An improved two-stage coal liquefaction process is provided, wherein solvent-boiling range phenolics, produced in the solubilization of the coal feed, are removed wholly or partially from recycle solvent at some point in the process prior to recycle to the first stage to control the level of phenolics in both stages of the process. The two-stage process involves a mild short contact time first stage operation, the removal of inorganic sulfur, ash and coal solids followed by a second stage operation, the severity of which is controlled as a function of the final product desired.

20 Claims, 1 Drawing Figure

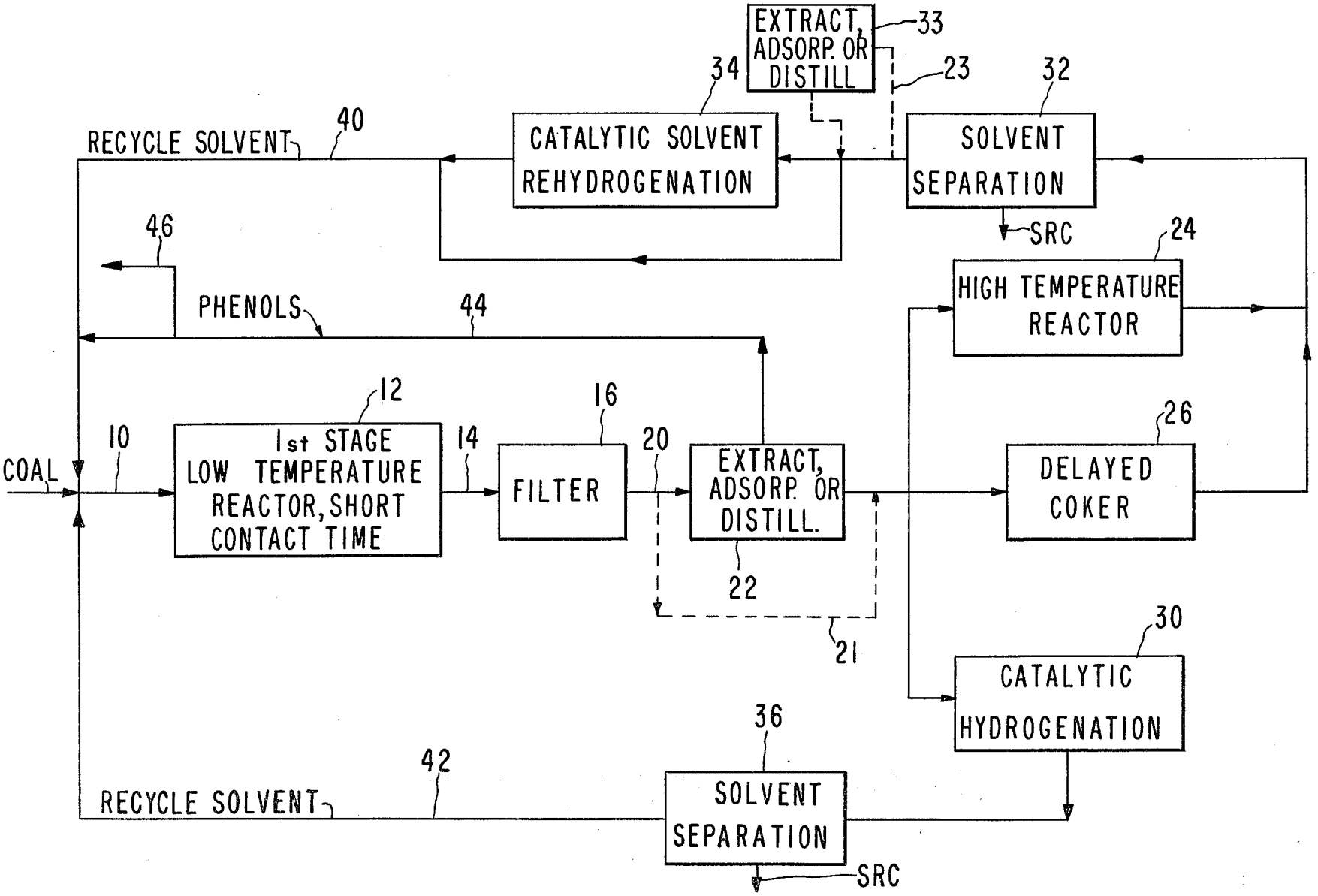
SOLVENT SEPARATION
32
SRC
HIGH TEMPERATURE REACTOR
24
DELAYED COKER
26
CATALYTIC HYDROGENATION
30
EXTRACT, ADSORP. OR DISTILL
33
23
CATALYTIC SOLVENT REHYDROGENATION
34
EXTRACT, ADSORP. OR DISTILL.
22
21
SOLVENT SEPARATION
36
SRC
FILTER
16
20
44
14
1st STAGE LOW TEMPERATURE REACTOR, SHORT CONTACT TIME
12
40
RECYCLE SOLVENT
PHENOLS
46
10
COAL
42
RECYCLE SOLVENT

PHENOLIC RECYCLE SOLVENT IN TWO-STAGE COAL LIQUEFACTION PROCESS

BACKGROUND OF THE INVENTION

This invention was made under contract with or supported by the Electric Power Research Institute, Inc. of Palo Alto, Calif.

1. Field of the Invention

With the increasing scarcity of oil and gas in conjunction with the continuously increasing price, the relative abundance of coal in the United States has greatly encouraged investigation to expand the usefulness of coal. Coal has had limited application because of high heteroatom content, particularly sulfur, and because it is a solid. Therefore, processing has been directed toward reducing the sulfur content, while enhancing the ability to melt a coal extract, which is substantially freed of inorganic materials. In addition, the processing has involved the introduction of hydrogen into the coal extract, so as to enhance its heating value and reduce the sooty character when it is burned.

A common process for coal liquefaction is referred to as solvent refined coal (SRC). In this process, coal, normally finely comminuted, is contacted with a hydrogen donor solvent at elevated temperatures, preferably in the presence of hydrogen, optionally in the presence of a catalyst. The resulting product is freed of inorganic materials and then separated into various fractions. In this process, there are many variables which enhance or diminish the economic attractiveness of the process. One consideration is the efficiency of hydrogen introduction into the coal fraction of interest, as compared to hydrogen useage for volatile hydrocarbons and the formation of water. A second consideration is the efficiency with which heteroatoms are removed, particularly sulfur and oxygen. A third consideration is the nature and yield of the desired product. A further consideration is the conversion of the coal into useable products.

In developing a process, the above as well as other considerations must be taken into account. Because of the extraordinarily large volumes of materials which are involved, small differences in efficiency or yield are of substantial significance. In any process which is developed, it is desirable that the materials employed in the process are for the most part generated internally.

2. Description of the Prior Art

Copending application Ser. No. 733,832, filed Oct. 18, 1976 describes a two-stage process of which the subject invention is an improvement. The relevant portions of that application, which describe the two-stage process in detail, are incorporated herein by reference.

SUMMARY OF THE INVENTION

In a two-stage process for producing solvent refined coal involving: a first stage where finely divided coal is contacted with a hydrogen donor solvent under relatively mild conditions, optionally in the presence of hydrogen; followed by removal of inorganics and coal solids; and a second stage treatment whose severity varies depending upon the nature of the desired product, an improvement is provided whereby at least a portion of the solvent is treated to lower the concentration of solvent-range phenolics in the said solvent.

BRIEF DESCRIPTION OF THE DRAWING

The FIGURE is a diagrammatic view of the process.

DESCRIPTION OF THE SPECIFIC EMBODIMENTS

In describing the subject invention, whenever the term "coal" is used, it is to be liberally interpreted and in its broadest aspect is to include any carbonaceous material less than about 88 percent carbon and containing substantial amounts of organic oxygen and pyritic and organic sulfur. Thus, the term may include materials such as anthracite coal, bituminous coal, subbituminous coal, lignite and peat.

According to the present invention, the sulfur and ash content of coal is reduced by a two-stage thermal solvation process effected in the presence of a hydrogen donor solvent material of selected boiling range suitable for recovery having a significant, but normally minor, amount of phenolics. The thermal solvation is achieved at elevated temperatures for short contact times normally in the presence of hydrogen.

The inorganic sulfur contained in the coal is separated by solubilization of the coal in the hydrogen donor material and removed along with ash components by filtration. Simultaneously, the oxygen content of the coal is also reduced. The operating conditions employed in the first stage dissolver minimize or avoid aromatizing and the inefficient consumption of hydrogen. The filtered product obtained from the first stage treatment and filtration is used as a feedstock in a second stage operation, under conditions of increased severity to produce products of different compositions, such as coke, a modified coal which is flowable upon heating to an elevated temperature, or a hydrogenated product having the characteristics of a turbine fuel.

The coal feed is mixed with a hydrogen donor solvent, either prior to or concomitantly with introduction into the first stage reactor. The coal will normally be ground to a particle size less than about one-half inch and usually greater than about 40 U.S. mesh. The coal may be wet ground in a ball mill, rod mill or hammer will to an acceptable particle size, before being mixed with the hydrogen donor solvent.

By hydrogen donor solvent it is intended to refer to relatively high boiling hydroaromatic compositions, such as compositions comprising polycyclic aromatics or partially hydrogenated aromatic solvents, e.g. tetralin, anthracene oil, coal oil, syntower deasphalted tar, heavy cycle oil, FCC clarified slurry oil, coke or gas oil and mixtures thereof. In the subject invention, also included is up to about 50 weight percent based on the total solvent composition of a phenolic type material. In initial operations, some or trace amounts are present; then in subsequent runs, or at a steady state condition, from 3% to 50% by weight, more usually from about 15 to 40% by weight of phenolics are present, usually of from six to fourteen carbon atoms, e.g. phenol, cresol, ethylphenol, cumol, butylphenol, isobutylphenol, and hexylphenol. For the most part, the phenols will be alkylphenols having alkyl groups of from one to six, more usually one to four carbon atoms and one hydroxyl. Usually the phenolics of from about seven to eight carbon atoms, will be at least about 50 weight percent of the total phenolics. The term "phenolics" as used herein, however, may also include aromatics of two or more fused rings which may have alkyl substituents.

The first stage extracting temperature will be below 850° F, preferably between about 600°-850° F and more preferably between about 750°-850° F. The total amount of solvent employed for the extraction will be in a weight ratio to coal of from about 0.5-10:1, preferably about 1-6:1, more preferably about 2-6:1 and particularly preferred about 2:1. The contact time will vary inversely with the temperature employed. The contact time will generally be in the range of about 0.5 to 15 minutes, more usually 0.5 to 10 minutes, and preferably 1 to 5 minutes. When hydrogen is introduced, it will normally be present at pressures in the range of about 300 to 2,000 psi.

The contact times and temperatures are chosen to obtain the desired degree of conversion, which will normally be at least 60% and less than about 90% of the MAF coal initially charged, preferably about 70% to 90%. At the same time, the contact time and temperatures are chosen to minimize formation of volatile hydrocarbons and aromatic ring saturation, both of which result in excess hydrogen consumption.

The results of the first stage are to reduce organic heteroatom content, form a pumpable liquid from the hydrocarbon donor solvent and soluble fraction of the coal, leave hydrogen in the heavy liquid product and minimize formation of low molecular weight hydrocarbons.

A solids separation step is required in this process to remove unreacted coal and ash from the solvent refined coal. Desirably, the separation will be carried out at this stage, which tends to provide reduced coke formation in the second stage reactor and, where a catalyst is employed in the second stage reactor, solid separation will normally be carried out prior to introduction of the first reactor effluent into the second reactor. The separation will normally be carried out at mildly elevated pressures, generally in excess of about 100 psi.

When the first reactor effluent is separated into a solid and liquid phase, various techniques may be employed, such as filtration, centrifugation, and the like, possibly including the use of precipitating agents which have been reported to promote separation. The solid phase will normally consist of inorganic sulfur compounds, particularly pyrite and pyrrohotite, ash, and unconverted coal. The liquid product from the first stage has a substantially reduced heteroatom content as compared to the original coal charge.

A substantial proportion, at least seventy percent, and preferably at least eighty percent by weight, and usually not more than ninety percent by weight of the phenolics will be separated from the first reaction effluent. Where the recyclable phenolics boil below about 600° F, preferably below about 550° F, the phenolics may be separated by distillation, any organics distilling with the phenolics being recycled with them to the first stage. Alternatively, the phenolics may be removed by known techniques, such as extraction with aqueous alkaline solution, followed by acidification and separation or further extraction and distillation of the extractant. Another preferred method of phenolics removal is by selective adsorption, using clays, resins, silica, alumina and the like. In a preferred embodiment, phenolics are maintained at from about 2 to 10 weight percent in the recycle solvent by selective adsorption.

In the next stage, the substantially solids free and phenolics free product, about 0 to 10% by weight will be transferred at a temperature in excess of 450° F, usually in the range of about 500° to 600° F to a second stage treatment. This product may now be treated in a variety of ways to improve its specifications for use as a fuel or chemical source and to produce the overall amount of recycle solvent required in the process. The recycle solvent will be a fraction boiling up to about 850° F. Thermal catalytic and noncatalytic treatment in the presence or absence of hydrogen, preferably in the presence of hydrogen in the second stage, may now be employed to further reduce heteroatom content, particularly sulfur.

If one wishes to prepare a clean solid fuel which is flowable at an elevated temperature, normally in excess of 300° F, the solids-free fluid is heated at a temperature of at least 850° F and not exceeding about 1000° F, normally from about 850° to 950° F. Contact times will generally vary from about 0.5 to 15 minutes, more usually from about 1 to 10 minutes, depending upon the temperature employed, as well as the nature of the final product. The product is then cooled under conditions whereby particles of a desired size are formed — for example, by spraying under moderately elevated pressures into an immiscible liquid, such as water. The resulting solvent refined coal may now be used as low-sulfur solid fuel.

In another noncatalytic mode, the product of the first stage may be subjected to a delayed coking operation, being used by itself or blended with other streams of reduced sulfur. The product is further processed at a relatively low temperature, generally in the range of about 800° to 950° F, preferably below about 900° F, for a long residence time normally substantially in excess of one minute, to produce a coke product of low sulfur, oxygen and hydrogen content. Volatilized product is vented and hydrogen donor material separated for recycle to the first stage.

Alternatively, a fuel oil can be provided, e.g., gas turbine oil, by a hydrotreating process. Various hydrotreating catalysts may be employed, such as the oxides and sulfides of cobalt, molybdenum, nickel, or tungsten and mixtures thereof, dispersed in a suitable inorganic matrix. Matrix materials such as alumina, silica, mixtures thereof and the like may be employed. The temperatures will generally be in the range of about 600° to 900° F, usually below about 850° F. Hydrogen pressures will generally vary from about 500 to 4000 psig, more usually from about 600 to 2500 psig. The choice of temperature and pressure will be a function of the degree of hydrogenation desired.

After the volatile materials have been flashed off, any solids that are formed in the second stage may be removed. The techniques indicated previously may be employed.

The resulting products will then be distilled, normally at reduced pressures, distilling the equivalent of materials boiling below about 750° F. These materials may then be recycled as solvent to the coal to be charged in the first reaction zone or further processed, as desired.

The results of the noncoking second stage is to further lower the heteroatom content to provide an acceptable fuel and to maintain a production of recycle solvent in excess of the quantity required for introduction of coal into the first stage.

Turning now to the Figure, coal is mixed with recycle solvent in conduit 10, preferably being raised to an elevated temperature of at least about 450° F during the mixing. The resulting slurry is introduced into the low temperature reactor 12, under conditions 800° F and about three minutes. The liquid effluent from the first stage reactor 12 is transferred through conduit 14 to filter 16 and filtered. The substantially ash free product is then transferred through conduit 20 to extraction or distillation zone 22, where the phenolic fraction is removed. If desired, it is just as feasible to subject the first stage product to extraction and distillation prior to the filtration step, in which case unit 22 will precede filter 16 in the flow line of the Figure. The substantially ash and phenolic free residue or raffinate may then be subjected to a variety of treatments depending upon the desired product. The first stage product may be transferred to high temperature reactor 24, delayed coker 26 or catalytic hydrogenator 30. In each instance, the resulting product is transferred to a solvent separation zone. From the high temperature reactor 24 and the delayed coke 26, the product is transferred to solvent separation zone 32, where the recycle solvent may be further processed by catalytic hydrogenation in catalytic hydrogenator 34. From the catalytic hydrogenation zone 30, the product is sent to solvent separation zone 36 for separation of the recycle solvent. The final clean solvent reduced final coal product (SRC) is also removed from the solvent separation zones 32 and 36.

The recycle solvent streams from solvent separation zones 32 and 36 are then transferred through conduits 40 and 42 respectively to conduit 10, where they are mixed with recycled phenol which is transferred from the phenol separation zone 22 through conduit 44 to conduit 10 or through a phenolics recovery conduit 46 to control the concentration in the first stage.

Alternatively, and equally preferable, the ash free product may be transferred through conduit 21 (dashed line) directly to the high temperature reactor 24, the delayed coker 26 or hydrogenator 30 without removal of phenolics. Then, after the solvent separation in unit 32, the phenolics in the separated solvents are at least partially removed in the extraction or distillation unit 33.

In accordance with the subject invention, an improved process is provided whereby a high level of phenolics is maintained, so as to insure substantial solubilization and conversion of coal in a first short contact time stage to allow for efficient removal of inorganics. The phenolics are then removed to prevent their interference with subsequent processing, and the phenolics poor product is then processed further to provide a final product having the desired characteristics. In this manner, the hydrogen donor capacity of the recycle solvent can be maintained at a relatively high level, while still retaining the solubilization efficiency of the total solvent employed for the solvent refined coal. That is, a recycle solvent having the combination of good hydrogen donor capacity and phenolics provides for efficient solubilization of the coal at a rapid rate and under relatively mild conditions. By subsequent removal of a major proportion of the phenolics, the product can be further processed without enhanced formation of tars or other undesirable high molecular weight materials.

Although the foregoing invention has been described in some detail by way of illustration and example for purposes of clarity of understanding, it will be obvious that certain changes and modifications may be practiced within the scope of the appended claims.

What is claimed is:

1. In a method for producing clean low sulfur fuel products from solubilized coal, wherein coal is solubilized at conditions at minimize hydrogen consumption and sulfur and ash are removed which method requires solubilizing, in a first stage, the coal in a hydrogen donor solvent material by contacting coal particles with said hydrogen donor solvent containing from 3 to about 50 weight percent phenolics at a temperature in the range of about 600°–850° F, for a time in the range of about 1 to 5 min., wherein the contact time varies inversely with temperature, and with a solvent-coal weight ratio of about 0.5–10:1; separating inorganic sulfur, ash and coal solids from the solubilized coal effluent from said first stage; upgrading in a second stage by treatment of the substantially solids free effluent from said first stage at a temperature in the range of about 600° to 1,000° F to produce a clean low sulfur fuel solubilized coal product; and separating at least a portion of said solvent material from said second stage product;

the improvement which comprises removing at least a major portion of the phenolics present in said first stage effluent prior to said upgrading in said second stage.

2. The method of claim 1 wherein at least a portion of the solvent material recovered from the second stage is recycled to the first stage.

3. The method of claim 2 wherein the sequence of steps comprises:

(a) solubilizing, in a first stage, the coal is a hydrogen donor solvent material at a temperature in the range of about 700° to about 850° F. for a time in the range of about 1 to 5 min., said time varying inversely with temperature, and selected to minimize hydrogen consumption from the said solvent material and both hydrogen loss and aromatization of the solubilized coal to form a solubilized coal product in the first stage; wherein said hydrogen donor solvent material has from about 3 to 50 weight percent of phenolics;

(b) separating inorganic sulfur, ash and unconverted coal solids from the mixture of solvent material and coal product of the first stage;

(c) separating out a major portion of the phenolics present in a solvent material, boiling in the range of up to 850° F.;

(d) subjecting the solubilized coal, in a second stage, to temperature conditions within the range of 600° to 1,000° F. for a residence time sufficient to upgrade the said solubilized coal product and produce a low sulfur clean fuel product, and (e) separating at least a portion of the said solvent material from the said solubilized coal product.

4. The method of claim 3 wherein at least a portion of the phenolics separated in Step (c) are returned to the first stage of Step (a) maintaining the said phenolic concentration.

5. The method of claim 3 wherein Step (c) precedes Step (b).

6. The method of claim 5, wherein the phenolics so separated are returned to the first stage of Step (a) maintaining the said phenolic concentration.

7. The method of claim 1 wherein at least a portion of the phenolics boiling in the solvent range is separated from the said solvent material after the second stage and the remaining solvent material is recycled to the first stage to provide a solvent material in the first stage having from 3 to 50 weight percent of phenolics.

8. The method of claim 1, wherein the phenolics concentration in the said solvent material is lowered by a treating step involving at least one of distillation, solvent extraction, adsorption and hydrogenation.

9. The method of claim 1, wherein said phenolics are present in said solvent material in the first stage in from about 15 to 40 weight percent of said solvent material.

10. The method of claim 1 wherein hydrogen gas is added to the first stage.

11. The method of claim 1 wherein hydrogen gas is added to the second stage.

12. The method of claim 1, wherein the solubilized coal in said second stage is maintained at a temperature in the range of about 800° to 950° F and above the first stage temperature for a time sufficient to produce a coke product of reduced sulfur content.

13. The method of claim 1, wherein the solubilized coal product in said second stage is subjected to catalytic hydrogenating conditions at a temperature in the range of about 600° to 900° F, a pressure of hydrogen in the range of about 500 to 4,000psig and a residence time selected to produce a refined coal product.

14. The method of claim 13 wherein the refined coal product is suitable for use as a turbine fuel.

15. The method of claim 1, wherein the solubilized coal product in the second stage melts at a temperature below about 200° C.

16. The method of claim 15 wherein the said solubilized coal product is produced by maintaining the temperature of the second stage at a temperature above that of the first stage in the range of about 850° to 1,000° F for a time in the range of about 0.5 to 15min.

17. The method of claim 15 wherein the said solubilized coal product is produced by subjecting the said solubilized coal effluent in the second stage to catalytic hydrogenation.

18. The method of claim 1 comprising:

(a) in a first stage, solubilizing coal in a hydrogen donor solvent material at a temperature in the range of about 700° to 850° F for a contact time in the range of about 1 to 5 minutes, wherein said time varies inversely with temperature, at a weight ratio of said material to coal of from about 2 to 6:1 and in the presence of hydrogen gas, wherein the hydrogen donor solvent has from about 3 to 50 weight percent of phenolics and wherein the conditions are selected to minimize hydrogen consumption and aromatization, to form a solubilized coal;

(b) separating inorganic sulfur, ash and unconverted coal solids from the solubilized coal;

(c) removing a major portion of phenolics from said solubilized coal;

(d) subjecting the solubilized coal, in a second stage, to temperature conditions within the range of 600° to 1,000° F for a residence time sufficient to upgrade the solubilized coal product and produce a clean low sulfur fuel product and removing at least a portion of the solvent material by distillation and recycling at least a portion of the resulting distillate to said first stage; and (e) maintaining in said solvent material phenolics in an amount of about 2 to 10 weight percent by removal of an appropriate amount of said phenolics from the said distillate by selective adsorption.

19. The method of claim 1 wherein the said two-stage process is a steady-state process in which the concentration of phenolics in the said solvent material in the first stage is maintained at 3 to 50% by weight and in the second stage is maintained at from 0 to 10% by weight.

20. The method of claim 8 wherein the phenolics are removed by selective adsorption.

* * * * *